United States Patent [19]

Brandt

[11] 4,109,319

[45] Aug. 22, 1978

[54] AGITATOR FOR LABORATORY TUBES AND FLASKS AND THE LIKE

[75] Inventor: J. Wayne Brandt, Lutherville, Md.

[73] Assignee: Spectroderm International, Fairfax, Va.

[21] Appl. No.: 642,231

[22] Filed: Dec. 18, 1975

[51] Int. Cl.[2] ..... B01F 11/00

[52] U.S. Cl. ..... 366/219

[58] Field of Search ..... 259/75, 72, 54, 74, 259/29, 12

[56] References Cited

U.S. PATENT DOCUMENTS

| | | | |
|---|---|---|---|
| 3,146,997 | 9/1964 | McKinney | 259/75 |
| 3,310,292 | 3/1967 | Moore | 259/72 |

*Primary Examiner*—Robert I. Smith

[57] ABSTRACT

An agitator device comprising drive means operatively connected to eccentric means with lower plate means and top plate means. The eccentric is fixed to the top plate means for driving it while the bottom plate means are provided with spaced bearing means fixed thereto. The top plate means are provided with complementary bearing means fixed thereto and are supported by the bearing means on the lower plate with the bearing means coacting with each other to prevent the top plate means from rotating so that the eccentric means and the bearing means cause the top plate means to move in a translatory motion for agitating liquids in the container placed on the top plate means.

3 Claims, 3 Drawing Figures

AGITATOR FOR LABORATORY TUBES AND FLASKS AND THE LIKE

The present invention relates to an agitator device for mixing the contents of laboratory tubes or flasks.

An object of the present invention is to provide a testing device, and more particularly, to a device which is particularly suitable for running serologic flocculation tests and the like and which is capable of precisely controlling both the duration and degree of agitation of test samples.

In many flocculation tests, for example, a precise quantity of a carefully prepared antigen emulsion of known strength is placed on a slide along with a specific amount of a patient's serum. After the antigen and serum have been mixed, usually by hand agitation, for a predetermined period, the slide is examined microscopically for a presence of agglutination or flocculation of the test materials. If flocculation is present to an appreciable extent, the test is regarded as positive, otherwise it is considered negative.

The test is essentially a screening procedure and the extent of flocculation depends not only on the reactivity of the serum and antigen but also on the degree and duration of the agitation. With excessive agitation, either in extent of duration, enough flocculation may occur to give a false indication of a positive reaction. Conversely, if the agitation is insufficient, a positive reaction might conceivably remain undetected. Under these circumstances, hand agitation is clearly inadequate for accurate testing. While mechanical agitators are available, these devices are generally regulated by timers which operate solely on the basis of elapsed time without regard to the number of oscillations of the agitator, and such timers are otherwise frequently subject to considerable variations in performance. Thus, even when mechanical agitators are used, the degree and duration of agitation are still variable factors, and the extent of such variation is sufficiently great to give rise to the possibility of misleading test results and the serious consequences which might be occasioned thereby.

Accordingly, it is an object of the present invention to provide an agitating test device of simple and durable construction that eliminates many of the aforementioned defects and disadvantages of conventional mechanical agitators used for such purposes heretofore.

It is another object of the present invention to provide an agitator testing device that has bearing means which are of such precision that they eliminate unnecessary play in this type of agitator used heretofore where the bearing means were of a resilient or elastomeric nature.

Still, a further object of the present invention is to provide an agitator testing device for laboratory purposes which requires a minimum of maintenance.

Various other objects and advantages of the present invention will be readily apparent from the following detailed description when considered in connection with the accompanying drawings forming a part thereof and in which.

Figure 1:
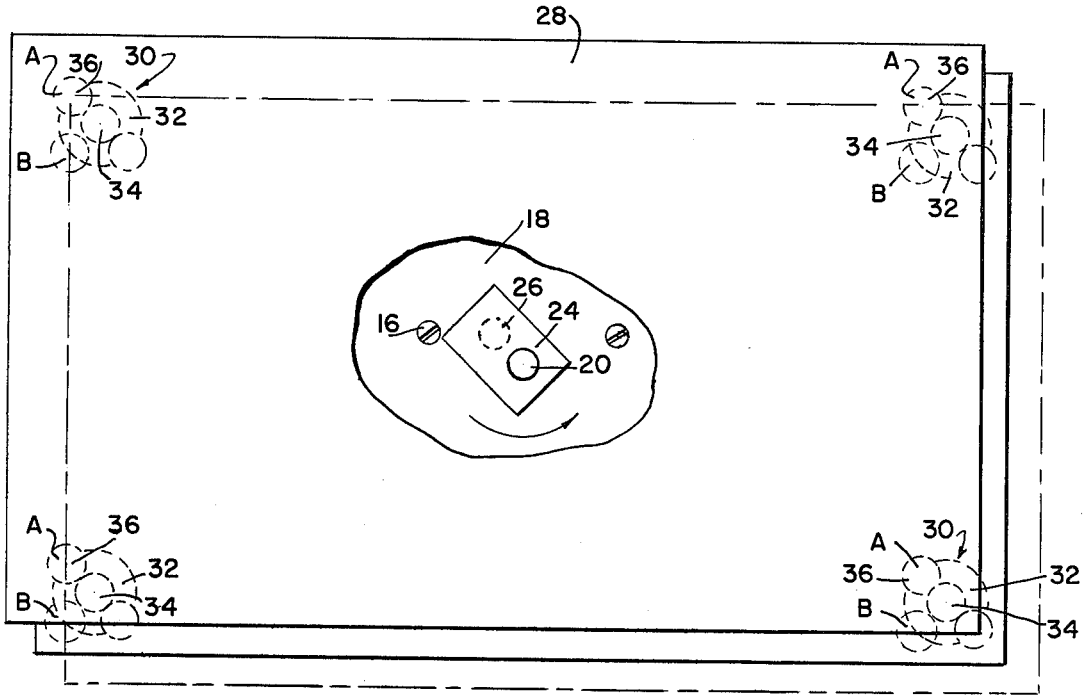
FIG. 1 is a top plan view of the device embodying the present invention illustrating the table upon which the liquid container is disposed with certain parts broken away for clarity and further illustrating different positions of the orbit of this movable table.
Figure 2:
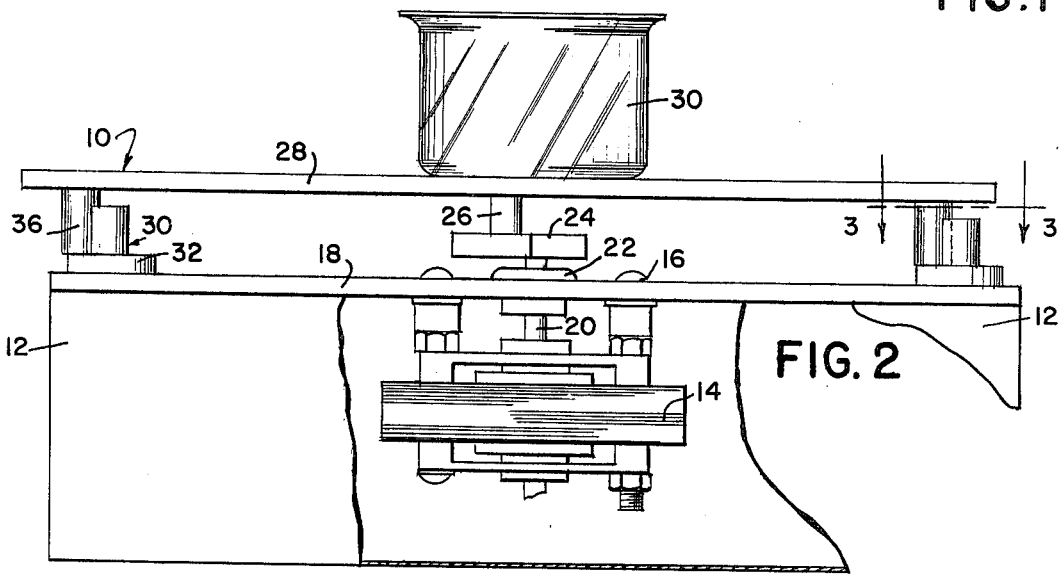
FIG. 2 is a side elevational view of the testing device embodied in the present invention.
Figure 3:
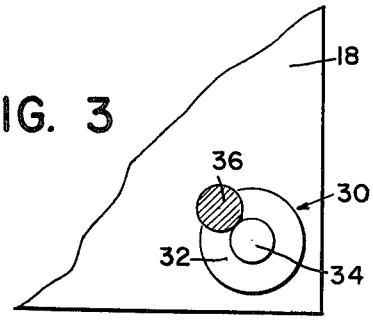
FIG. 3 is a detailed view taken along the lines 3—3 of FIG. 2.

Referring to the Figures, the reference numeral 10 generally designates the agitator device embodying the present invention and comprises a casing or housing 12 in which is disposed an electric motor 14. The motor is secured by bolt members 16 to a plate 18 which forms the top of the housing.

The plate 18 which will hereinafter be referred to as the lower plate is substantially rectangular in shape as best seen in FIG. 1.

The drive shaft 20 of the motor extends through a ball bearing 22 secured to the plate 18 and has an eccentric 24 fixed to its upper end so that the eccentric member 24 is rotated by the drive shaft 20. A vertically extending pin 26 extends above the eccentric 24 and has its upper end rigidly connected to a substantially rectangular upper or top plate 28. The lower end of the vertical pin 26 is disposed in a bearing in the eccentric 24.

The lower plate 18 is provided with preferrably Teflon or nylon members 30 with members 30 being disposed adjacent the four corners of the rectangular plate 18. The members 30 comprise a lower circular flange 32 which is secured to the lower plate 18 by any suitable means and has a concentrically disposed vertical pin 34 extending upwardly above the flange.

The upper plate 28 is provided with complementary bearing members made of Teflon or nylon in the form of vertically downwardly extending pins 36 of substantially greater length than the corresponding pin 34 on the member 30. These pins 36 are rigidly secured to the four corners of upper plate 28 and are of sufficient length so as to rest on the lower flanges 32 and to support the upper plate and a container 30 thereon. The pins 36 are further of sufficient size so as to be in rubbing contact with the outer diameter of the pins 34 so that both of these members provide complementary bearing members which prevent rotation of the plate 28 but rather cause it to move in a translatory orbit, as hereinafter described.

When it is desired to utilize the agitating testing device, the present invention, in a research or medical laboratory, a beaker 30 is disposed on the plate 28 for the desired serological test.

It should be noted that the sum of the radius of the top plate bearing pin 36 and the minor radius of fixed bearing pin 34 are equal to the distance between the centers of drive shaft 20 and vertical pin 26. Thus, as eccentric 24 is rotated the top plate 28 will be orbited about the center of shaft 20 without rotation of the top plate 28.

The angle of contact of each set of bearings varies, of course, with orbital position, but there are always at least two opposing sets inhibiting or restraining rotation. For example, in the position shown in FIG. 1 and indicated as A with the shaft 20 being turned in a counterclockwise direction as marked by the arrow in FIG. 1, in this 45° position the upper left hand corner complementary bearings 36 and 34 and the lower right hand corner bearing sets 36, 34, also marked A, are doing little, while the upper right hand corner sets of bearings stops the clockwise rotation of the upper plate 28 and the bearing sets in the lower left hand corner stops the counterclockwise rotation of the upper plate.

In the orbital position of 45° counterclockwise from the position shown and marked in FIG. 1 as B position, which is a 45° counterclockwise position from position A, the two lower sets of bearings in the lower left and right hand corners inhibit counterclockwise rotation and the two upper bearing sets inhibit clockwise rotation.

In connection with the design of the testing device of the present invention, critical design factors are as follows:

1. The geometry of the top plate bearings 36 to pin 26 on top plate 28 must be identical to the geometry of the fixed bearing pins 34 to the shaft center 20 on the base or lower plate 18.

2. The sum of the minor radius of fixed bearing pins 34 and the radius of top plate bearing pins 36 must equal the distance between the centers of drive shaft 20 and pin 26.

3. Three sets of bearings are the minimum number which will work; however, tolerances are then more critical.

From the foregoing description is apparent that the present invention provides a simplified and durable agitator testing device for laboratory use which eliminates any gear wheels or complicated mechanisms and which further permits a more precise utilization of the device in view of the fact that the bearing members which support the translatory orbiting plate upon which a beaker or flask is disposed provides a precise control eliminating frequent replacement of parts as encountered heretofore in elastomeric or spring-type restraining members in which an eccentric member is utilized to give translatory motion from a driven rotary member.

Inasmuch as various changes may be made in the relative location of the several parts without departing from the scope of the invention it is not meant to limit the invention except by the scope of the appended claims.

What is claimed is:

1. An agitator testing device comprising a housing with a horizontal top forming a lower plate, another plate disposed in spaced relationship with said lower plate and forming an upper plate, a single eccentric member disposed centrally of said upper plate and rigidly secured thereto by a single vertical pin extending downwardly from the upper plate and extending into said eccentric and secured thereto for rotation therewith, at least three bearing means disposed equally about said eccentric member, each bearing means comprising circular flanges secured to the top surface of said lower plate with central upwardly extending pins, and downwardly extending pins secured to said upper plate having there bottom ends resting on said circular flanges and their sides in frictional contact with said central upwardly extending pin but without being fixedly secured thereto, and a motor disposed centrally of said housing having a shaft extending through said lower-plate and directly and fixedly connected to said eccentric to permit translating orbital movement of the upper plate.

2. The device of claim 1 wherein said pins and flanges are of plastic material.

3. The device of claim 1 wherein said upper plate is rectangular.

* * * * *